US007348110B2

(12) United States Patent
Vanous et al.

(10) Patent No.: US 7,348,110 B2
(45) Date of Patent: Mar. 25, 2008

(54) THERMALLY DEVELOPABLE IMAGING MATERIAL

(75) Inventors: James C. Vanous, Roseville, MN (US); Bryan V. Hunt, Fridley, MN (US); Robert R. Brearey, Oakdale, MN (US); Steven H. Kong, Woodbury, MN (US); Mark C. Skinner, Afton, MN (US); Thomas C. Geisler, Cottage Grove, MN (US)

(73) Assignee: Carestream Health, Inc., Rochester, NY (US)

( * ) Notice: Subject to any disclaimer, the term of this patent is extended or adjusted under 35 U.S.C. 154(b) by 0 days.

(21) Appl. No.: 11/608,937

(22) Filed: Dec. 11, 2006

(65) Prior Publication Data

US 2007/0082302 A1 Apr. 12, 2007

Related U.S. Application Data

(62) Division of application No. 10/789,740, filed on Feb. 27, 2004.

(51) Int. Cl.

| | |
|---|---|
| ***G03C 1/498*** | (2006.01) |
| ***G03C 5/26*** | (2006.01) |
| ***G03C 5/29*** | (2006.01) |
| ***G03C 5/04*** | (2006.01) |

(52) U.S. Cl. ..... 430/9; 430/351; 430/353; 430/394; 430/619

(58) Field of Classification Search ..... 430/351, 430/353, 394, 619, 9

See application file for complete search history.

(56) References Cited

U.S. PATENT DOCUMENTS

| | | | | |
|---|---|---|---|---|
| 5,804,355 | A * | 9/1998 | Bosschaerts et al. | 430/346 |
| 5,953,039 | A | 9/1999 | Boutet et al. | |
| 6,114,600 | A | 9/2000 | Ow et al. | |
| 6,569,614 | B1 | 5/2003 | Shoji | |
| 6,582,892 | B2 | 6/2003 | Kong et al. | |

FOREIGN PATENT DOCUMENTS

| | | |
|---|---|---|
| EP | 0600586 B1 | 9/1993 |

* cited by examiner

*Primary Examiner*—Richard L. Schilling

(57) ABSTRACT

A photothermographic material having a Dmin and Dmax optical density. The material includes a support having hereon one or more thermally-developable imaging layers which are developable to produce an image when the photothermographic material is thermally processed; and an area disposed along a length of at least one edge of the photothermographic material, wherein the area has an optical density less than the Dmax and greater than the Dmin of the photothermographic material.

7 Claims, 4 Drawing Sheets

THERMALLY DEVELOPABLE IMAGING MATERIAL

CROSS-REFERENCE TO RELATED APPLICATIONS

This is a Divisional of application U.S. Ser. No. 10/789,740, filed Feb. 27, 2004.

FIELD OF THE INVENTION

The invention relates generally to the field of thermally developable imaging materials such as photothermographic materials.

BACKGROUND OF THE INVENTION

Silver-containing photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet or infrared radiation) and developed by the use of thermal energy.

These materials, also known as "dry silver" materials, generally comprise a support having coated thereon: (a) photosensitive catalyst (such as silver halide) that upon such exposure provides a latent image in exposed grains that is capable of acting as a catalyst for the subsequent formation of a silver image in a development step, (b) a non-photosensitive source of reducible silver ions, (c) a reducing composition (usually including a developer) for the reducible silver ions, and (d) a hydrophilic or hydrophobic binder. The latent image is then developed by application of thermal energy.

The imaging arts have long recognized that the field of photothermography is distinct from that of photography. Photothermographic materials differ significantly from conventional silver halide photographic materials that require processing with aqueous processing solutions.

For example, in photothermographic imaging materials, a visible image is created by heat as a result of the reaction of a developer incorporated within the material. In contrast, conventional photographic imaging materials require processing in aqueous processing baths at moderate temperatures to provide a visible image.

In photothermographic materials, a small amount of silver halide is used to capture light and a non-photosensitive source of reducible silver ions (for example, a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

U.S. Pat. No. 6,582,892 (Kong), commonly assigned and incorporated herein by reference, describes a heat-stabilized thermally developable imaging material. As disclosed in U.S. Pat. No. 6,582,892, photothermographic materials can be used, for example, in conventional black-and-white photothermography, in electronically generated black-and-white hardcopy recording. They can be used in microfilm applications, in radiographic imaging (for example, digital medical imaging), and industrial radiography. The absorbance of these photothermographic materials between 350 and 450 nm is desirably low (less than 0.5), to permit their use in the graphic arts area (for example, imagesetting and phototypesetting), and in proofing. Thermally developable materials have gained widespread use in several industries, particularly in radiography. Thus, photothermographic materials are useful for medical radiography to provide black-and-white images.

Such photothermographic materials can be sensitive to radiation at a wavelength of at least 700 nm, and at a wavelength of from about 750 to about 1400 nm.

Photothermographic materials are processed in a thermal processor that employ heat to develop the material to generated a developed image. While photothermographic materials have been well received in the industry, there continues a need to improve the characteristics of photothermographic materials, such that when processed, a high quality processed image is provided.

SUMMARY OF THE INVENTION

An object of the present invention is to provide a photothermographic material having improved characteristics when thermally processed.

Another object of the present invention is to provide such a material that, when thermally processed, comprises an area of mid-range density along one edge of the material.

These objects are given only by way of illustrative example, and such objects may be exemplary of one or more embodiments of the invention. Other desirable objectives and advantages inherently achieved by the disclosed invention may occur or become apparent to those skilled in the art. The invention is defined by the appended claims.

According to one aspect of the invention, there is provided a photothermographic material having a Dmin and Dmax optical density. The material includes a support having hereon one or more thermally-developable imaging layers which are developable to produce an image when the photothermographic material is thermally processed. The material further includes an area disposed along a length of at least one edge of the photothermographic material, the area having an optical density less than the Dmax and greater than the Dmin of the photothermographic material.

According to another aspect of the invention, there is provided a method of thermally processing a photothermographic material comprising a support having hereon one or more thermally-developable imaging layers. The method comprises the steps of: exposing an area along at least one edge of the photothermographic material such that, when thermally processed by a thermal processor, the image density of the area will be less than a Dmax and greater than a Dmin of the photothermographic material; and providing means to transport the photothermographic material to the thermal processor such that the edge is first transported through the thermal processor.

According to yet a further aspect of the invention, there is provided a method of forming a visible image. The method comprises the steps of: exposing a first area of a photothermographic material to form a latent image, the photothermographic material comprising a support having hereon one or more thermally-developable imaging layers which are developed when the photothermographic material is thermally processed; exposing a second area, different than the first area, of the photothermographic material disposed along a leading edge of the photothermographic material such that, when developed, the second area has an image density less that the Dmax and greater than the Dmin of the photothermographic material; transporting the photothermographic material to a thermal processor such that the leading edge first contacts the thermal processor; and thermally processing the first and second areas to develop the visible image.

BRIEF DESCRIPTION OF THE DRAWINGS

The foregoing and other objects, features, and advantages of the invention will be apparent from the following more particular description of the preferred embodiments of the invention, as illustrated in the accompanying drawings.

DETAILED DESCRIPTION OF THE INVENTION

Figure 1:
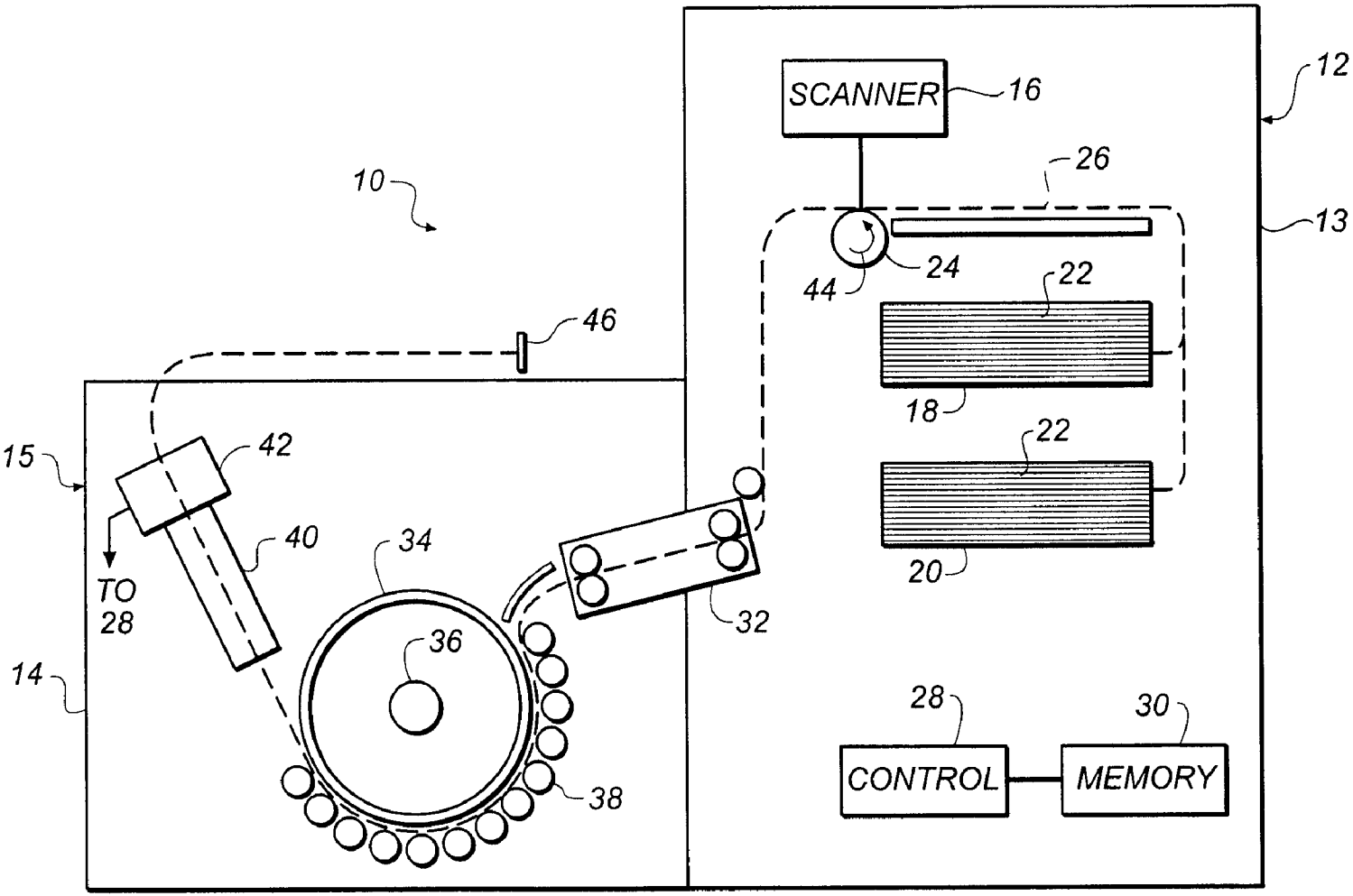
FIG. 1 shows a diagrammatic view of a laser imaging system suitable for thermally processing a photothermographic material in accordance with the present invention.

The following is a detailed description of the preferred embodiments of the invention, reference being made to the drawings in which the same reference numerals identify the same elements of structure in each of the several figures.

As used herein, "photothermographic material(s)" means a construction comprising at least one photothermographic emulsion layer or a photothermographic set of layers (wherein the silver halide and the source of reducible silver ions are in one layer and the other essential components or desirable additives are distributed, as desired, in an adjacent coating layer) and any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

As used herein, sensitometric terms "photospeed" or "photographic speed" (also known as "sensitivity"), and "contrast" have conventional definitions known in the imaging arts.

The sensitometric terms Dmin and Dmax have conventional definitions known in the imaging arts. In photo-thermo-graphic materials, Dmin is considered herein as image density achieved when the photo-thermo-graphic material is thermally developed without prior exposure to radiation. It is the average of eight lowest density values on the exposed side of the fiducial mark. In thermo-graphic materials, Dmin is considered herein as image density in the non-thermally imaged areas of the thermo-graphic material. Dmax is the maximum image density achievable when the photo-thermo-graphic material is exposed to a particular radiation source and then thermally developed. Dmin and Dmax can also be written as $D_{min}$ and $D_{max}$.

It is noted that not every/all medical images include/show/exhibit regions of Dmin and Dmax. Dmin and Dmax are inherent characteristics of the material; the photothermographic material is characterized by Dmin and Dmax optical density parameters.

Further, the density term "mid-tone" or "mid tone density" refers to optical densities of the image in the middle of the of dynamic range of the photothermographic material.

Photothermographic material, also referred to as film, media, or sheet, is processed in a thermal processor that employ heat to develop the material. One type of thermal processor uses a heated drum for developing an exposed material brought into contact with the drum. Another type of thermal processor uses a flat bed processor for developing the exposed material. For example, U.S. Pat. No. 5,953,039 (Boutet) and U.S. Pat. No. 6,114,660 (Donaldson), both commonly assigned and incorporated herein by reference, disclose photothermographic processors suitable for developing photothermographic material. Other types of thermal processors may be known to those skilled in the art.

FIG. 1 shows an exemplary laser imaging apparatus 10. Apparatus 10 includes a laser printer 12 and processor 14. Although printer 12 and processor 14 are shown as housed in separate units, it will be understood that they could be integrated into one housing. In the specific application described herein, printer 12 is a medical image laser printer for printing medical images on photothermographic film which is thermally processed by thermal processor 14. The medical images printed by printer 12 can be derived from medical image sources, such as medical image diagnostic scanners (MRI, CT, US, PET), direct digital radiography, computed radiography, digitized medical image media (film, paper), archived medical images, and the like.

Printer 12 includes printer housing 13, laser scanner 16, supplies 18,20 for unexposed photothermographic film 22, a scan drum 24, film path 26, control 28, memory 30, printer/processor film interface 32. Processor 14 includes processor housing 15, interface 32, drum 34 heated by lamp 36, hold-down rollers 38 located around a segment of the periphery of drum 34, exposed film cooling assembly 40, densitometer 42, and output tray 46.

Apparatus 10 operates in general as follows. A medical image stored in memory 30 modulates the laser beam produced by the laser of scanner 16. The modulated laser beam is repetitively scanned in a fast or line scan direction to expose photothermographic film 22. Film 22 is moved in a slow or page scan direction by slow scan drum 24 which rotates in the direction of arrow 44. Unexposed photothermographic film 22, located in supplies 18,20, is moved along film path 26 to slow scan drum 24. A medical image is raster scanned onto film 22 through the cooperative operation of scanner 16 and drum 24.

After film 22 has been exposed, it is transported along path 26 to processor 14 by printer/processor film interface 32. The exposed film 22 is developed by passing it over heated drum 34 to which it is held by rollers 38. After development, the film 22 is cooled in film cooling assembly 40. Densitometer 42 reads the density of control patches at the front edge of film 22 to maintain calibration of the laser imaging apparatus 10. The cooled film 22 is output to tray 46 where it can be removed by a user.

As discussed above, photothermographic film includes a photothermographic emulsion on one side or two sides of a support. Cooling of the film provides good adhesion characteristics between the emulsion and the support. However, if the heated film is not sufficiently cooled prior to coming into contact (including sliding and rubbing contact) with another entity (for example, a guide or blade) as the film leaves drum 34, the emulsion might be marred or "peeled" away from the support, potentially leaving an aesthetically undesirable "ragged" edge.

Figure 2:
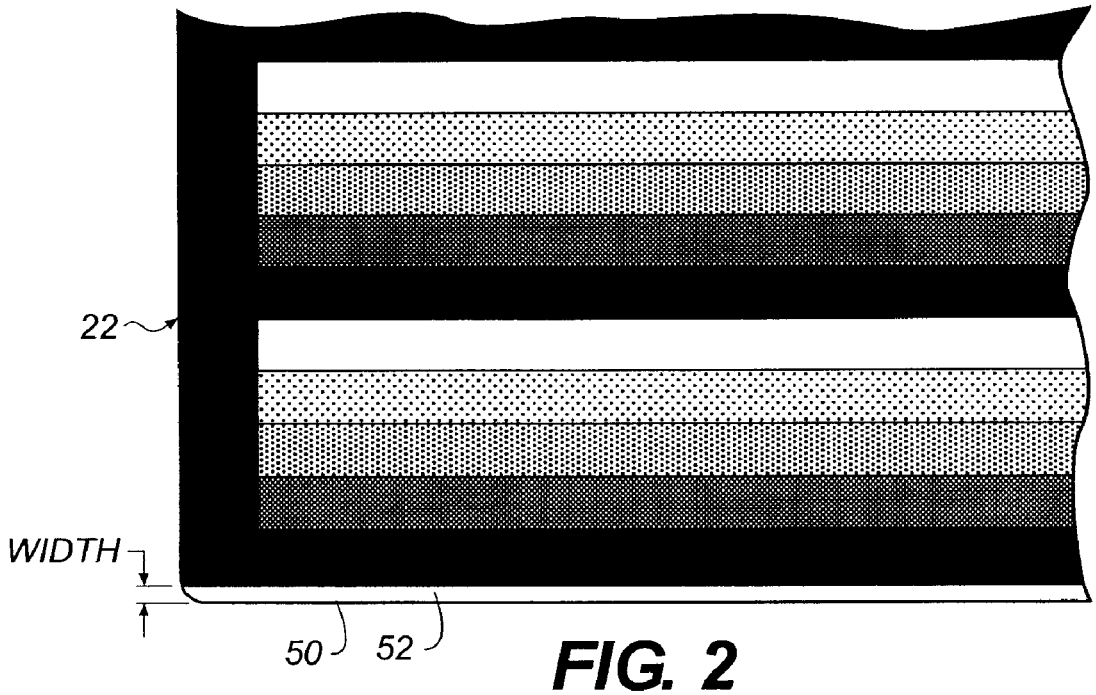
FIG. 2 (PRIOR ART)
FIG. 2 shows a prior art thermally processed photothermographic material.

To reduce/eliminate such an occurrence, existing films include a leading edge having an area having a clear/transparent Dmin. FIG. 2 shows an exemplary prior art film 22 having a leading edge 50 comprising an area 52 of Dmin. Described alternatively, the border of the leading edge of the film is clear/transparent. As shown, Dmin area 52 is a strip disposed along the length of leading edge 50. Typically, the width of Dmin area 52 is in the order of about 0.2 mm to about 10 mm. Such an area is employed since the adhesion properties/characteristics of the processed emulsion to the support are more aggressive at a density of Dmin than at a density of Dmax. Therefore, by providing a Dmin area at leading edge 50 of film 22, any emulsion peel-back is avoided/reduced as the hot film leaves the heated drum.

However, the clear/transparent strip/edge of film 22 will allow light to pass through when placed on a light box. Such an emission of light can be an annoyance/distraction to a radiologist as they read the printed image. The clear/transparent leading edge can be particularly distracting if one or more other edges/borders of the film have a value of Dmax.

The present invention addresses the problem noted above. More particularly, the present invention provides a film having a non-Dmin area disposed at its leading edge.

The present invention provides a photothermographic material comprising an area, adjacent a leading edge, having an image density intermediate Dmin and Dmax. More particularly, the area comprises a mid-density range (or mid-range density). That is, having a density in the range of about 0.5 to about 2.5 optical density (OD). In a preferred embodiment, the density is at least about 1.2 to about 2.5 optical density (OD). In a preferred embodiment, mid-density range is not greater than about 2.5 optical density.

Dmax can be in the range of from about 2.4 to about 3.6 optical density. Though some materials have a Dmax greater than 3.6 OD, for example, a Dmax of 4.0 OD or greater. The mid-density range can be between about 20 percent to about 80 percent of Dmax of the material.

Applicants have recognized that providing such a non-Dmin area adjacent the leading edge of the film improves the "readability" and aesthetic qualities of the film. More particularly, Applicants have noticed that imaging the leading edge to a mid-density reduces/minimizes the annoyance/distraction effects which occur with a clear/transparent edge.

For example, if the leading edge is at Dmin and another edge is at a Dmax of 3.1 optical density, the leading edge is obvious and undesirable. In contrast, if the leading edge is at a mid-density of about 1.8 optical density and another edge is at a Dmax of 3.1 optical density, the leading edge is not readily noticed.

Figure 3:
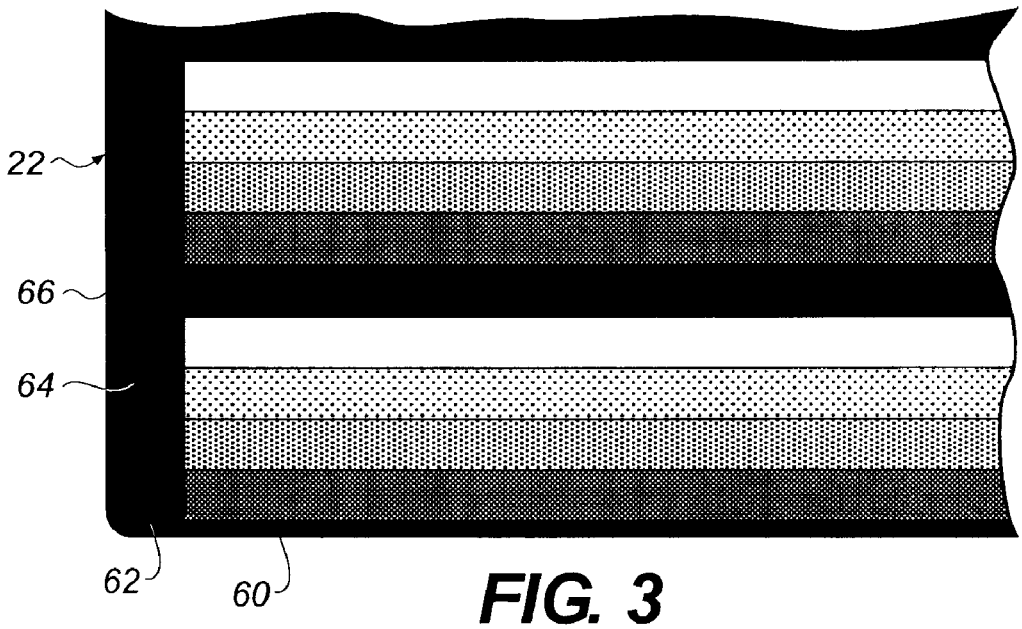
FIG. 3 shows a thermally processed photothermographic material in accordance with the present invention.

FIG. 3 shows a thermally processed photothermographic material in accordance with the present invention. As shown, film 22 has a leading edge 60 comprising an area 62 of mid-density range (which can be denoted as Dmid). As shown, area 62 is not readily distinguishable from an area 64 disposed along another edge 66, wherein area 64 has a density of Dmax.

Figure 4A:
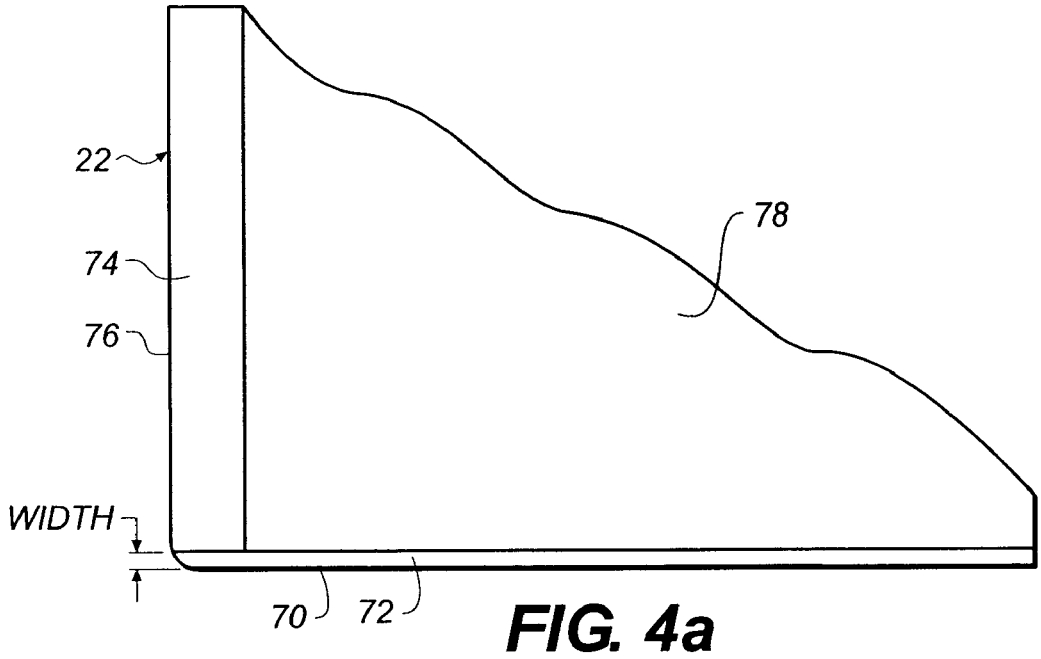
FIG. 4*a* shows a diagrammatic view of the photothermographic material in accordance with the present invention.
Figure 4B:
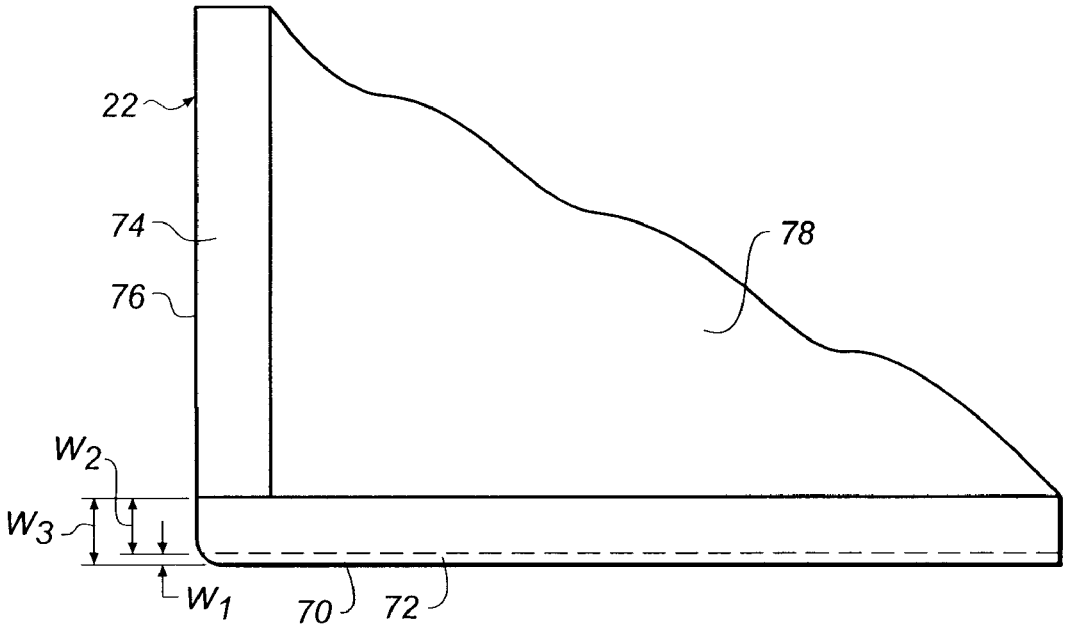
FIG. 4*b* shows an enlarged/exaggerated view of the diagrammatic view of FIG. 4*a*.

FIGS. 4*a* and 4*b* are provided to more generally illustrate the regions/areas illustrated in FIG. 3. As shown, FIG. 4 shows a plurality of regions/areas of a portion of film 22. Film 22 includes a leading edge 70 and a first region 72 disposed along the length of leading edge 70 proximate leading edge 70. A second region 74 is disposed along another edge 76 adjacent edge 76. A third region 78 is disposed inboard of leading edge and other edge 76 and is representative of the imaging area of film 22.

First region 72 is the area of Dmid (i.e., mid-range density), as described above, thus corresponding with area 62 of FIG. 3. Second region 74 is the area wherein a density of Dmax is typically employed (or typically a density in the range of Dmax), thus corresponding with area 64 of FIG. 3.

As indicated above with regard to the prior art, the width of Dmin area 52 (shown in FIG. 2) is in the order of about 0.2 mm to about 10 mm. In the present invention, as best illustrated in FIG. 4*b*, a width W3 of first region 72 (i.e., the area having mid-density range) can range up to 25 mm from edge 70. Preferably, area 72 is disposed as close to leading edge 70 as possible, that is, that a width/dimension W1 is minimal/minimized. Starting first region 72 about 0.1 mm (i.e., a W1 of 0.1 mm) inboard of (i.e., spaced from) edge 70 has been found to be suitable for Applicants' application, as has starting about 0.2-0.5 mm (W1) inboard of edge 70. As such, a width W2 (i.e., W3—W1) of first region 72 can range from about 0.1 mm to about 25 mm.

Applicants have determined that the adhesion characteristics of the processed emulsion are sufficient at mid-density for Applicants' application, that is, to minimize peel back so as to provide an acceptable/suitable processed image.

Figure 5:
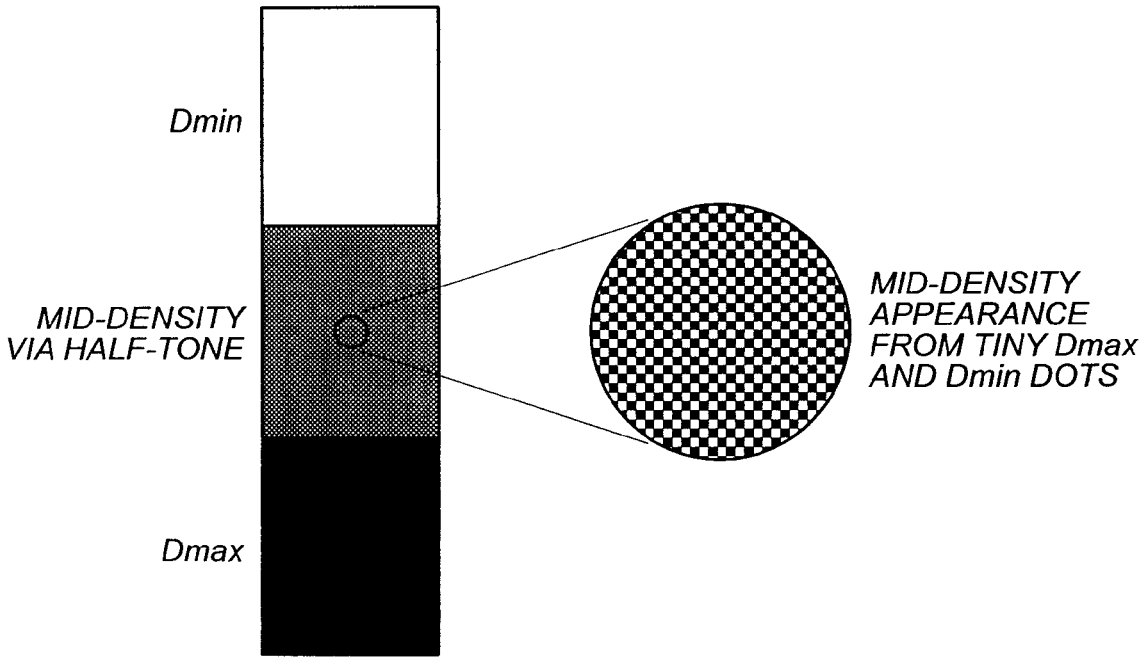
FIG. 5 shows an example of a half-tone suitable for the present invention.

In another embodiment, region 72 adjacent leading edge 70 is comprised of a half-tone style image. That is, region 72 comprises a pattern to give a mid-range density appearance. An example is shown in FIG. 5, wherein a plurality of small/tiny dots/circles of Dmin and Dmax provide the area with a mid-density appearance. Those skilled in the art may recognize other patterns to provide a similar appearance. Such an embodiment would reduce/minimize the area of high density exposure—thereby resulting in a mid-density appearance—yet, provide areas of Dmin to "tack down" the emulsion to the support.

In a further embodiment, region 72 may comprise a gradient optical density having a first, lower density at the edge (for example, a density of 1.0 OD) which increases to a higher density (i.e., toward Dmax) over a dimension of approximately 0.1 mm-0.5 mm. Such an increase in density can be linear, exponential, or the like.

In the photothermographic material, a photocatalyst (such as photosensitive silver halide), a non-photo-sensitive source of reducible silver ions, a reducing agent composition, and any other additives used in the present invention are generally added to one or more binders. Suitable binders include polyvinyl butyral resins for an imaging layer, and cellulose acetate butyrate resins for a protective overcoat or topcoat layer. Mixtures of binders can also be used. An acrylic or methacrylic acid ester polymer, such as polymethylmethacrylate can be mixed with cellulose acetate butyrate, for example, in an amount of at least 5% by weight of the total overcoat binder, to promote adhesion of an overcoat to an imaging layer.

Hardeners for various binders may be present. Useful hardeners are well known and include diisocyanate compounds as described for example, in EP-0 600 586B1 and vinyl sulfone compounds as described in EP-0 600 589B1. One useful hardener is DESMODUR® N3300, a trimeric aliphatic hexamethylene diisocyanate available from Bayer Chemicals (Pittsburgh, Pa.). The amount of isocyanate in the protective overcoat is at least 1% by weight of the binder, and preferably at least 5% of the overcoat binder. The amount of isocyanate in the imaging layer is at least 0.5% by weight of the binder, and preferably at least 2% of the imaging layer binder.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

PARTS LIST

10 laser imaging apparatus
12 printer
13 printer housing
14 processor
16 laser scanner
18,20 supplies
22 photothermographic film
24 scan drum
26 film path
28 control
30 memory
32 printer/processor film interface
34 drum
36 lamp
38 hold-down rollers
40 exposed film cooling assembly
42 densitometer
44 arrow
46 output tray
50 leading edge
52 Dmin area
60 leading edge
62 area
64 area
66 edge
70 leading edge
72 first region
74 second region
76 edge
78 third region

What is claimed is:

1. A method of forming a visible image, the method comprising the steps of:

exposing a first area of a photothermographic material to form a latent image, the photothermographic material comprising a support having thereon one or more thermally-developable imaging layers which are developed when the photothermographic graphic material is thermally processed;

exposing a second area, different than the first area, of the photothermographic material to form a second latent image different from that in the first area, the second area disposed along the entire length of a leading edge of the photothermographic material; the area extending up to 25 mm from the leading edge; such that, when developed, the second area has an image density less than the Dmax and greater than the Dmin of the photothermographic material;

exposing a third area, different from the first and second areas, of the photothermographic material to form a third latent image different from those in the first and second areas, the third area disposed along the entire length of a side edge of the photothermographic material such that, when developed, the third area has an image density of about Dmax of the photothermographic material;

transporting the photothermographic material to a thermal processor such that the leading edge first contacts the thermal processor; and thermally processing the first, second, and third areas to develop the visible images.

2. A method of forming a visible image, the method comprising the steps of:

exposing a first area of a photothermographic material to form a latent image, the photothermographic material comprising a support having thereon one or more thermally-developable imaging layers which are developed when the photothermographic material is thermally processed;

exposing a second area, different than the first area, of the photothermographic material to form a second latent image different from that in the first area, the second area disposed along the entire length of a leading edge of the photothermographic material; the area extending up to 25 mm from the leading edge; such that, when developed, the second area has an image density less than the Dmax and greater than the Dmin of the photothermographic material;

transporting the photothermographic material to a thermal processor such that the leading edge first contacts the thermal processor; and thermally processing the first and second areas to develop the latent images to form visible images, wherein the second area comprises a half-tone style image to give a mid-range density appearance or comprises a gradient optical density having a lower density at the edge which increases to a higher density over a dimension of approximately 0.1 mm-0.5 mm.

3. The method of claim 1 wherein the second area extends from about 0.1 to about 25 mm from the leading edge.

4. The developed photothermographic material formed by the method of claim 1.

5. The method of claim 1 wherein the second area comprises a half-tone style image to give a mid-range density appearance or comprises a gradient optical density having a lower density at the edge which increases to a higher density over a dimension of approximately 0.1 mm-0.5 mm.

6. The method of claim 2 wherein the second area extends from about 0.1 to about 25 mm from the leading edge.

7. The developed photothermographic material formed by the method of claim 2.

* * * * *